United States Patent [19]

Evans

[11] Patent Number: 4,869,145

[45] Date of Patent: Sep. 26, 1989

[54] CONVERTIBLE TREMOLO APPARATUS FOR STRINGED MUSICAL INSTRUMENT

[76] Inventor: John A. Evans, 1746 N. Orange Dr., Apt. 1103, Hollywood, Calif. 90028

[21] Appl. No.: 124,062

[22] Filed: Nov. 23, 1987

[51] Int. Cl.[4] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 2,741,146 | 4/1956 | Fender | 84/313 |
| 3,181,409 | 5/1965 | Burns et al. | 84/313 |
| 3,437,001 | 4/1969 | Kraft | 84/313 |
| 4,137,812 | 2/1979 | Franzmann | 84/313 |
| 4,171,661 | 10/1979 | Rose | 84/313 |
| 4,383,466 | 5/1983 | Shibuya | 84/313 |
| 4,555,970 | 12/1985 | Rose | 84/313 |
| 4,656,916 | 4/1987 | Gressett, Jr. | 84/313 |

*Primary Examiner*—E. T. Hix

*Assistant Examiner*—Brian W. Brown

*Attorney, Agent, or Firm*—Mason, Fenwick & Lawrence

[57] ABSTRACT

A musical instrument comprises a tremolo apparatus which may be converted from a semi-floating mode in which a spring urged stop engages a movable sustain block in some positions thereof to a free-floating mode in which the spring-urged stop does not engage the sustain block in any position thereof. The spring-urged stop is provided with a releasable latch for latching it into the non-engaging position, the latch including a bayonet joint. An indicator apparatus indicates the position of the sustain block relative to a fixed reference target, to enable rapid location of the sustain block for the tuned position of the strings of the instrument. A pusher block of magnetic material is provided for insertion between the sustain block and the spring-urged stop for assistance in urging the spring to the position in which it is locked out of engagement with the sustain block, to establish the free-floating mode.

18 Claims, 1 Drawing Sheet

CONVERTIBLE TREMOLO APPARATUS FOR STRINGED MUSICAL INSTRUMENT

BACKGROUND OF THE INVENTION

The present invention relates to stringed musical instruments, and more particularly to a tremolo apparatus for a stringed musical instrument such as a guitar.

Tremolos are provided on stringed musical instruments for the purpose of changing the tension on all of the strings simultaneously, to thereby change the pitch of the strings. A widely used tremolo apparatus is disclosed in Rose U.S. Pat. No. 4,555,970. In that apparatus, the strings of a guitar are attached to a sustain block which is pivotably mounted so that rotation of the sustain block changes the tension, and therefore the pitch of all of the strings simultaneously. Counteracting the spring force of the strings is a set of two or three tremolo springs which are attached to the sustain block, and to a fixed anchor bracket. A spring urged stop engages the sustain block in a manner such that the spring force of the spring urged stop tends to counteract the force applied by the tremolo springs. This apparatus provides a semi-floating tremolo mode of operation in that the spring-urged stop, in applying a counteracting force to the force of the tremolo springs causes the tremolo apparatus to be more readily used. However, this tremolo apparatus is not convertible to a free-floating tremolo mode without substantial disassembly of it, such as by the complete removal of the springs of the spring-urged stop.

The guitarists familiar with a guitar having a semi-floating tremolo system recognize that it presents a number of advantages, which include the following. The guitar will not go out of tune if one of the strings breaks. Since the strings are not interdependent, tuning of the guitar is easier. The guitarist is enabled to play while resting his hand on the bridge to mute the strings, without causing the guitar to go sharp in pitch. Further, the semi-floating tremolo system allows one string of the guitar to be bent sharp while another is held at a fixed pitch, without the note which is held going flat. This system allows the guitarist to tune one or more of the strings without affecting the tuning of the remaining strings, and also allows the use of a fine tuning mechanism for pitch bending purposes on single strings without affecting the tuning of adjacent strings However, a known disadvantage of the semi-floating tremolo system is that there is created an audible click when the tremolo unit is fluctuated between sharp and flat positions, being created by the sustain block forcibly engaging the stop element. There is precluded, because of this action, the ability of the guitar to produce a voice-like vibrato which fluctuates above and below the standard pitch; does not enable a smooth and consistent tremolo action, and does not have the ability to produce certain unusual sound effects.

It is known, in addition, that the tremolo springs in a tremolo apparatus may be attached to an adjustable anchor: such a construction is shown in Fender U.S. Pat. No. 2,741,146, in which the tremolo springs are connected at one end to the sustain block, and at their other ends to an anchor plate which is of L-shape, with adjusting screws passing through one arm of the L, so that by threading the screws more or less into the body of the guitar, the anchor plate may be moved so as to apply more or less tension to the tremolo springs.

SUMMARY OF THE INVENTION

A tremolo apparatus is provided which may be readily converted between a semi-floating mode and a free-floating mode. In the semi-floating mode, the force of the musical instrument strings, which are under tension, is counteracted by a set of tremolo springs, the spring forces and string forces being applied to opposite arms of a lever arrangement, which includes a sustain block to which the ends of the musical strings and the ends of the tremolo springs are attached. A spring-urged stop engages the sustain block in a manner so as to at least partially counteract the force of the tremolo springs. The spring urged stop includes a lock-out device, which may be selectively engaged so as to prevent the application of forces from the spring of the spring-urged stop to the sustain block. Specifically, the stop is in the form of a cylinder movable axially in a fixed hollow cylinder with a spring within the hollow cylinder and acting on the movable cylinder: the hollow cylinder has a bayonet slot in it formed of a first portion extending axially and a second portion extending transversely of the first portion; a detent is connected to the movable cylinder and extending through the slot. The tension of the strings is adjusted, either for the semi-floating or free-floating mode by movement of an anchor plate for the tremolo springs, and an indicator is provided for indicating the in-tune position of the strings in both modes: the indicator includes a fixed reference target and an indicator reference on the sustain block which may be brought into substantial coincidence by adjustment of the position of the anchor of the tremolo springs. A pusher block is provided for insertion between the sustain block and the stop element to enable the sustain block to be moved to compress the spring of the stop, so that it may be locked in the retracted position, thereby giving the free-floating mode: the pusher block is preferably magnetic so that it can be readily stored on a suitable part of the instrument, such as the sustain block, on the side adjacent to the stop element.

Among the objects of the present invention are the provision of a tremolo apparatus which may be readily converted between semi-floating and free-floating modes.

Another object of the present invention is to provide such a convertible tremolo apparatus which includes readily adjustable means for adjusting the tension of tremolo springs, and therefore of the musical strings, in a readily operated manner.

Yet another object of the present invention is to provide a convertible tremolo apparatus which includes an indicator reference system for indicating the proper position of the sustain block in both the free-floating and semi- floating modes.

A still further object of the present invention is to provide, in a convertible tremolo apparatus, a pusher block and means for readily storing the pusher block for transfer between storage and use positions.

Further objects include the provision of a tremolo apparatus for guitars which permits the production of voice-like vibrato capable of fluctuating above and below the standard pitch; the provision of a smooth and consistent tremolo action, and which enables the production of unusual sound effects prevalent particularly in rock music.

Other objects and many of the attendant advantages of the present invention will be readily understood from the following specification, drawings and claims.

DESCRIPTION OF THE PREFERRED EMBODIMENT

Figure 1:
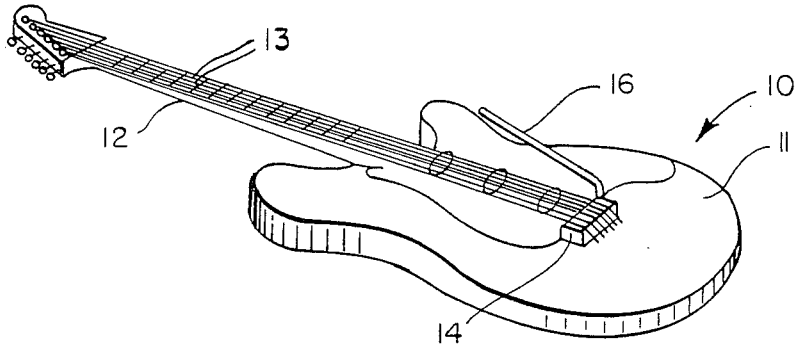
FIG. 1 is a perspective view of a guitar having a tremolo apparatus in accordance with the present invention.

Referring now to the drawings, wherein like or corresponding reference numerals are used for like or corresponding parts throughout the several views, there is shown in FIG. 1 a guitar 10 having the conventional solid body 11, neck 12, and strings 13. The strings 13 are attached it one end to a bridge 14, which forms a part of the tremolo apparatus, and includes the tremolo arm 16.

Figure 2:
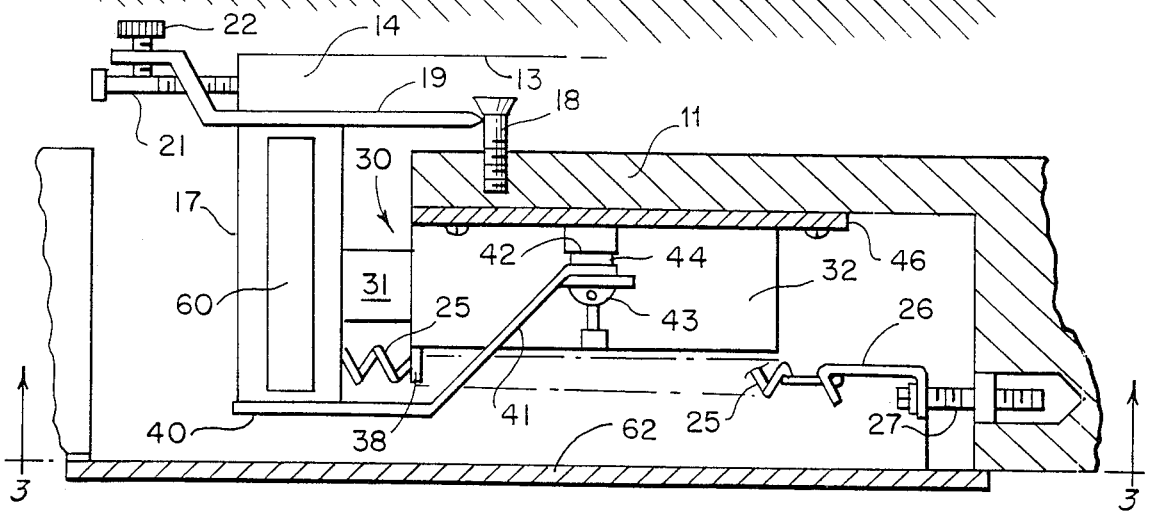
FIG. 2 is a vertical cross-sectional view showing the tremolo apparatus of the present invention.

Referring now to FIG. 2, the bridge 14 is part of a block 17, generally referred to as a sustain block. The strings 13 are shown attached to the sustain block 17. The guitar body 11 has one or more mounting bolts 18, there being preferably two such mounting bolts, against which a pivot arm 19 is urged, the sustain block 17 being rotatable on an axis formed at the junction of pivot arm 19 and mounting bolt 18. A screw 21 secures the end of a string 13 against the sustain block 17, and a fine tuning screw 22 may be provided. The arm 16, as will be understood, is connected to the pivot arm 19 so that they move together.

Figure 3:
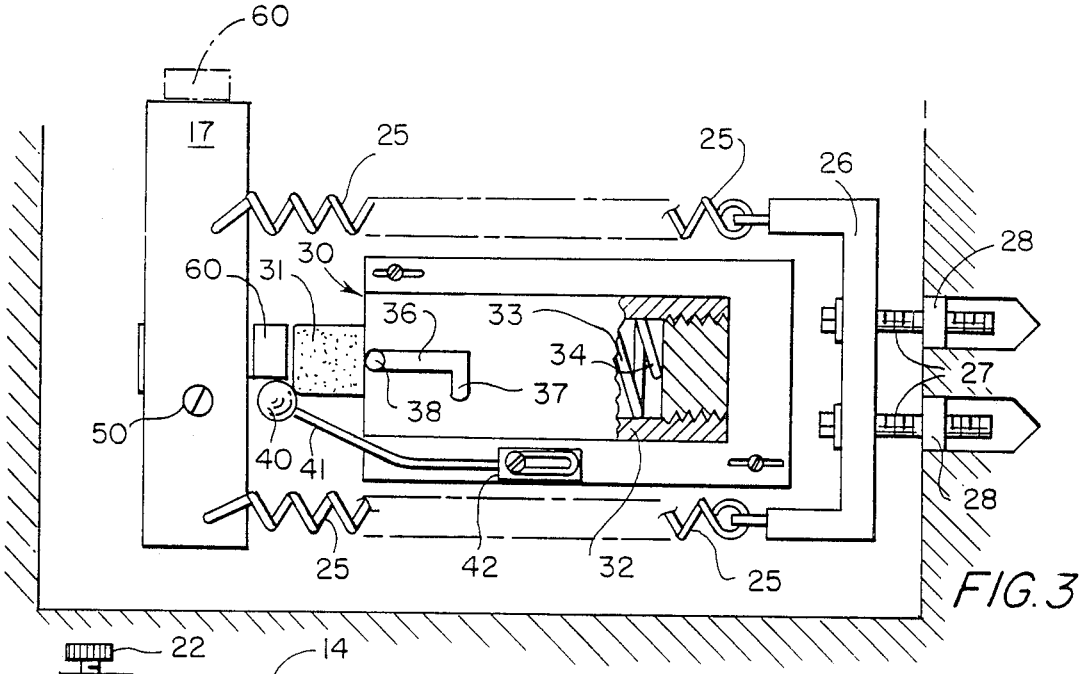
FIG. 3 is a view taken on the line 3—3 of FIG. 2.

A set of tremolo springs 25 is provided, one being shown in FIG. 2, the tremolo springs 25 being anchored at one end to the sustain block 17, and at the opposite end to an adjustable anchor 26. The anchor 26 is preferably in the form of U-shaped bracket, as shown in FIG. 3, and is penetrated by a pair of Allen screws 27, each of which is threaded into a nut 28 fixed into the body of guitar 10. The tremolo springs 25 apply a force to the sustain block 17 which counters the force produced by the tension of the strings 13, and the counter-force of the tremolo springs 25 may be adjusted by adjustment of the screws 27.

A spring-urged stop, generally designated 30, is provided, and includes a movable stop element 31 shown in FIG. 2 as having its free, outer end in engagement with the sustain block 17. Stop element 31 is carried within a hollow cylinder 32 (see also FIG. 3) and is axially movable therein. The hollow cylinder 32 has a spring 33 within it, which engages the movable stop element 31, urging it to the left as shown in FIGS. 2 and 3. An adjustable abutment 34 is threaded into the end of the hollow cylinder 32 opposite the stop element 31, and one end of spring 33 engages the abutment 34. Hollow cylinder 32 is provided with a bayonet slot including a first portion 36 which extends axially, and a second portion 37 which extends transversely of the first portion 36. A detent 38, in the form of a pin, is secured to and extends radially from the stop element 31, passing through the wall of the hollow cylinder 32, as permitted by the bayonet slot. When the detent 38 is moved axially in the portion 36, it will reach the portion 37 of the bayonet slot and may be moved in a rotary manner to retain the stop element 31 in retracted position against the urging of the spring 33.

As shown in FIG. 3, a reference target 40 which is preferably in the form of an annulus is carried by a target arm 41, the opposite end of which is secured to a block 42. In FIG. 2, the arm 41 is shown secured to the block 42 by a screw 43, the screw 43 also passing through shims 44, which provide the necessary thickness for adjustment purposes. The mounting block 42 is, in turn, carried by a mounting plate 46 secured to the guitar 10. For cooperating with the reference target 40, there is provided on the bottom of the sustain block 17 a reference 50 which is movable with the sustain block 17. When the sustain block is in position such that the reference 50 substantially coincides with the reference target 40, the strings 13 will be in tune. Reference 50 may be a screw, paint, decal, etc.

Also shown in FIG. 3 is the sustain block 17 moved to a position in which it is remote from the end of the stop element 31, with a pusher block 60 in position between and engaging a surface of the sustain block 17 and the stop element 31. By movement of the tremolo arm 16, the sustain block 17 may cause the spring 33 of stop 30 to be compressed, sustain block 17 forcing the pusher block 60 against the stop element 31, and causing stop element 31 to move to the right. During this movement, the pin 38 will proceed along the portion 36 of the bayonet slot, and when it reaches the portion 37, the pin 38 may be moved into the portion 37, so as to lock or latch the stop element 31 in the retracted position, with the spring 33 compressed. With the stop element 31 in the latched or locked position, the tremolo apparatus, including the sustain block, will be free-floating, being subjected only to the forces of the strings 13 and the tremolo springs 25. Once the pin 38 is moved into the latched position, the pusher block 60 is removed. Preferably, the pusher block 60 is of magnetic material, and since the sustain block 17 is of ferrous metal, it may be positioned against the opposite surface of sustain block 17, as shown in dashed lines in FIG. 3, and in FIG. 2, this being a convenient storage position for the pusher block 60.

A further feature of construction of the present invention is the provision of a readily removable cover plate 62 for access to the tremolo adjusting apparatus hereinabove described. The cover plate 62 is preferably secured by such readily disengageable means as a magnetic element or elements, or by Velcro attachment (not shown).

In use, and assuming that the tremolo apparatus is in the semi-floating mode shown in FIG. 2, in which the sustain block is acted upon by the force of the tension of the strings 13, the counteracting force of the tremolo springs 25, and the force of spring 33 acting through the stop element 31, the guitar 10 being played in the conventional manner with tremolo effect by manipulation of the tremolo arm 16. To convert the tremolo apparatus to the free-floating mode, the cover plate 62 is removed in a rapid manner, as permitted by the above-noted readily disconnectable attachment provision. The tremolo arm 16 is moved so as to shift the sustain block 17 to the position generally as shown in FIG. 3, in which it is spaced from the outer end of the stop element 31. The pusher block 60 is then removed from its position on the sustain block 17 shown in FIG. 2, and inserted between the sustain block 17 and the stop element 31. By movement of the tremolo arm 16, spring 33 is compressed, and the stop element 31 is latched in inoperative position with movement of the pin 38 into the portion 37 of the bayonet slot. The pusher block 60 is then returned to its storage position, and the adjusting screws 27 rotated to cause the sustain block to move to the position in which the strings 13 are in tune, this position being indicated when the reference 50 coincides with the reference target 40. Thus, the strings 13 are in tune, and the tremolo apparatus is in the free-floating mode, since the stop element 31 is not in engagement with the sustain block 17. The cover plate 62 is replaced, and playing of the guitar 10 is then resumed.

To return to the semi-free-floating mode, the back plate 62 is removed, and preferably, the pusher block 60 is removed from the storage position shown in FIG. 2 and inserted into the position shown in FIG. 3, being engaged by the sustain block 17 and the end of stop element 31. The pin 38 is then moved to the portion 36 of the bayonet slot, and the spring 33 is then allowed, by a resistive force on the tremolo arm 16, to move the stop element 31 outwardly: this prevents the stop element 31 from forcefully striking the sustain block 17 when the latch pin 38 is moved to the release position. The pusher block 60 is then placed in the storage position, and the screws 27 are tightened, to again align the reference 50 on sustain block 17 with the target 40, thereby restoring the strings to the tuned position, but with the tremolo apparatus in the semi-floating mode. The cover plate 62 is then replaced in the above noted manner. The change or conversion of the tremolo apparatus from one mode to the other may be accomplished very rapidly, in the order of approximately two minutes. Conventionally, the tuning of a free-floating system requires anywhere from five to fifteen minutes.

There has been provided a musical instrument, such as a guitar, with a tremolo apparatus, which tremolo apparatus may be readily converted between semi-floating and free-floating modes. This is accomplished by including in the tremolo apparatus a spring urged stop construction which includes a latching or lock-out feature which may be readily changed between positions in which the application of the force of the spring-urged stop to the sustain block is prevented, or not, in a readily selected manner. Further, there has been provided a tremolo apparatus which is not only convertible, but which is provided with references for indicating the tuned position of the strings, regardless of whether the tremolo apparatus is in the free-floating or semi-free-floating mode. Still further, there is provided a tremolo apparatus in which a pusher block is provided for assisting in the movement of a spring urged stop to and from retracted position, the pusher block being made of magnetic material for ready and accessible storage on a ferrous metal part.

It will be obvious to one skilled in the art that various changes may be made without departure from the spirit of the invention, and therefore the invention is not limited to that shown in the drawings and described in the specification, but only as indicated in the appended claims.

What is claimed is:

1. In a stringed musical instrument, tremolo apparatus comprising:

(a) a movable mounted sustain block having the strings of said musical instrument attached thereto, (b) tremolo spring means engaging said sustain block for counteracting the force of said strings upon movement of said sustain block, (c) second spring means engageable with said sustain block in a range of positions thereof for counteracting the force of said tremolo spring means, and (d) means for selectively preventing application of the force of said second spring means to said sustain block in all positions of said sustain block, whereby said stringed musical instrument may be played and said sustain block moved to all positions thereof without said second spring means applying a force to said sustain block or played with said second spring means applying a force to said sustain block in some positions thereof.

2. The stringed musical instrument of claim 1, said second spring means comprising a stop element engageable with said sustain block, a spring urging said stop element towards said sustain block, said preventing means comprising detent means for said stop element.

3. The stringed musical instrument of claim 2, said detent means comprising a cylinder surrounding said spring of said second spring means, a bayonet slot in said cylinder, and a latch extending from said stop element and into said slot.

4. The stringed musical instrument of claim 1, and further comprising means for indicating the position of said sustain block.

5. The stringed musical instrument of claim 4, said position indicating means comprising a fixed reference target on said instrument, and a movable reference carried by said sustain block for cooperation with said fixed reference target.

6. The stringed musical instrument of claim 5, wherein said movable reference is on said sustain block.

7. The stringed musical instrument of claim 6, wherein said fixed reference target comprises an arm, and means for adjustably securing said arm to an immovable part of said instrument.

8. The stringed musical instrument of claim 1, and further comprising means for adjusting the tension of said tremolo spring means.

9. The stringed musical instrument of claim 8, and further comprising means for indicating the position of said sustain block.

10. The stringed musical instrument of claim 1, and further comprising a pusher bloc manually positionable between said sustain block and said second spring means.

11. The stringed musical instrument of claim 10, wherein said pusher block is magnetic, for attachment by magnetic force to a ferrous metal member for storage.

12. In a stringed musical instrument, tremolo apparatus comprising:

a sustain block, means for attaching strings of said stringed musical instrument to said sustain block, means for movably mounting said sustain block, tremolo spring means for applying a force to said sustain block for applying tension to said strings, and means for indicating that position of said movable sustain block in which said strings are in tune comprising a reference on said movable sustain block and an immovable reference target.

13. The tremolo apparatus of claim 12, and further comprising means for adjusting the tension of said tremolo spring means.

14. The tremolo apparatus of claim 12, and further comprising spring-urged stop means for applying a force to said sustain block for counteracting the force of said tremolo springs, and means for selectively preventing the application of force from said spring-urged stop means to said sustain block in all positions of said movable sustain block.

15. The tremolo apparatus of claim 14, and further comprising a pusher block for selective engagement between said sustain block and said spring-urged stop means.

16. The tremolo apparatus of claim 15, wherein said pusher block is of magnetic material.

17. In a stringed musical instrument, a tremolo apparatus convertible for operation between semi-floating and free floating modes comprising:

a sustain block, means for attaching the strings of said musical instrument to said sustain block, means for mounting said sustain block for movement for changing simultaneously the tension of the strings, tremolo springs for applying a force to said sustain block for tensioning said strings, and means for selectively applying an additional force to said sustain block for counterbalancing the tension of said strings in some positions of said sustain block, or for preventing the application of said additional force to said sustain block in all positions thereof.

18. In a stringed musical instrument, tremolo apparatus convertible for operation between semi-floating and free floating modes comprising:

(a) a sustain block having an operating arm connected thereto, (b) means for securing the strings of said stringed musical instrument to sustain block, (c) means for movable mounting said sustain block for selectively increasing or decreasing the tension of said strings by movement of said sustain block by said operating arm, (d) tremolo spring means engaging said sustain block for counteracting the force of said strings, (e) a movable stop, (f) means for mounting said movable stop in position to be engaged by said sustain block upon movement of said sustain block in a direction increasing string tension and decreasing tremolo spring means tension, (g) second spring means for urging said stop towards said sustain block and for increasing resistance to movement of said sustain block in said last mentioned direction upon engagement of said movable stop by said sustain block, and (h) means for selectively moving said stop to a position in which said stop is not engageable by said sustain block in any position thereof.

* * * * *